United States Patent [19]

Horiuchi et al.

[11] Patent Number: 4,503,662

[45] Date of Patent: Mar. 12, 1985

[54] METHOD AND APPARATUS FOR YARN PIECING IN FASCIATED YARN SPINNING

[75] Inventors: Mitsunori Horiuchi, Kariya; Yoshihisa Suzuki, Chiryu; Yoshiharu Yasui, Toyoda; Kazuo Seiki, Kariya, all of Japan

[73] Assignee: Kabushiki Kaisha Toyoda Jidoshokki Seisakusho, Aichi, Japan

[21] Appl. No.: 420,858

[22] Filed: Sep. 21, 1982

[30] Foreign Application Priority Data

| | | | |
|---|---|---|---|
| Sep. 28, 1981 | [JP] | Japan | 56-153454 |
| Mar. 25, 1982 | [JP] | Japan | 57-47737 |
| Mar. 25, 1982 | [JP] | Japan | 57-47738 |

[51] Int. Cl.[3] ..... D01H 15/00; D01H 5/28

[52] U.S. Cl. ..... 57/261; 57/22; 57/328; 57/333

[58] Field of Search ..... 57/22, 261, 263, 328, 57/333

[56] References Cited

U.S. PATENT DOCUMENTS

| | | | |
|---|---|---|---|
| 3,992,865 | 11/1976 | Tuchida et al. | 57/328 |
| 4,107,911 | 8/1978 | Yamana et al. | 57/328 X |
| 4,112,658 | 9/1978 | Mokihashi | 57/328 |
| 4,121,409 | 10/1978 | Uchida et al. | 57/261 X |
| 4,169,350 | 10/1979 | Yamana et al. | 57/261 X |
| 4,219,998 | 9/1980 | Farnhill | 57/328 X |

*Primary Examiner*—John Petrakes

*Attorney, Agent, or Firm*—Burgess, Ryan & Wayne

[57] ABSTRACT

In the piecing operation, the broken ends of a yarn and a fiber bundle are sucked into a suction nozzle, and therein are entangled due to twists imparted to the fiber bundle by first vortices utilized for forming a fasciated yarn. The broken end of the yarn may be twisted in reverse of the fiber bundle by second vortices. Further, third vortices weaker than the first vortices may be used instead of the first vortices. The apparatus comprises jets for generating the second and third vortices and piping for transporting air to the jets and from the suction nozzle, as well as a control circuit thereof.

9 Claims, 12 Drawing Figures

METHOD AND APPARATUS FOR YARN PIECING IN FASCIATED YARN SPINNING

BACKGROUND OF THE INVENTION

Prior Art Description

This invention relates to yarn piecing for a fasciated yarn spinning frame. Fasciated yarn spinning in which a fiber bundle of staple fibers is introduced into an air tube and is twisted to form a yarn by means of vortices whirling around the fiber bundle has become recently well-known. It has been remarkably developed to attain a delivery speed of 150 m/sec.

Since fasciated yarn has a substantially non-twisted core portion in its construction, a piecing operation is very difficult to perform either by hand or by using machinery.

SUMMARY OF THE INVENTION

It is an object of the present invention to provide a method and an apparatus by which yarn breakage occurring in a fasciated yarn spinning frame can easily be remedied.

It is another object of the present invention to provide a method and an apparatus for yarn piecing for a fasciated yarn spinning frame in which the resultant pieced yarn has no twistless portion in the vicinity of the remedied part thereof and has a uniform tensile strength all along the yarn length.

These and other objects of and many of the advantages of the present invention will be better understood with reference to the following detailed description taken in connection with the accompanying drawings.

DETAILED DESCRIPTION OF THE PREFERRED EMBODIMENT

Figure 1:
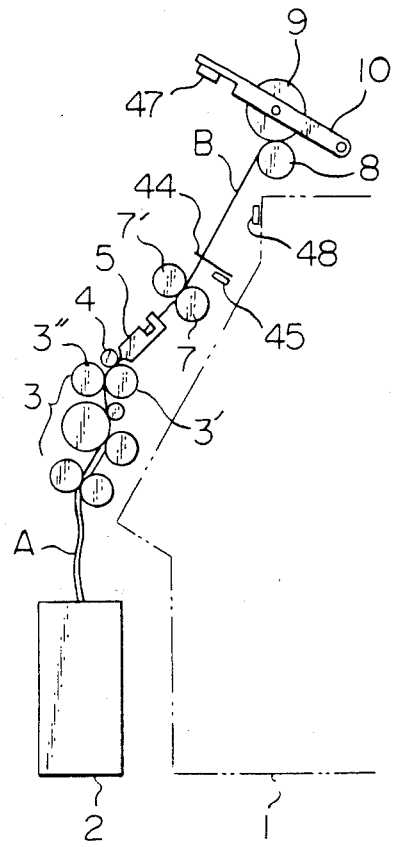
FIG. 1 is a diagrammatical side view of the fasciated spinning frame to which the present invention is applied.

In FIG. 1, one of the spinning units in a fasciated yarn spinning frame is illustrated. The unit comprises a drafting device 3, a deflection roller 4, an air tube 5, a pair of draw-off rollers 7, 7', a take-up roller 8, and a pair of cradle arms 10, 10' for pivoting a yarn bobbin, all of which are secured on a frame 1. A fiber bundle in the form of a sliver A is fed to the drafting device 3 from a can on a floor. The sliver A is attenuated by the drafting device 3 and is delivered from a pair of front rollers 3', 3'' as a fiber ribbon. The fiber ribbon is deflected in the traveling direction by the deflection roller 4, which is forcibly driven at the same speed as a front roller 3', and then is introduced into a fiber passage 6 pierced through a body of the air tube 5. The fiber ribbon is twisted by vortices caused by an airstream ejected into the fiber passage 6. Finally, the fiber ribbon is drawn off from the fiber passage 6 as a yarn B by the draw-off rollers 7, 7' and is wound on the bobbin supported by the cradle arms 10 in the form of a package 9.

Figure 2:
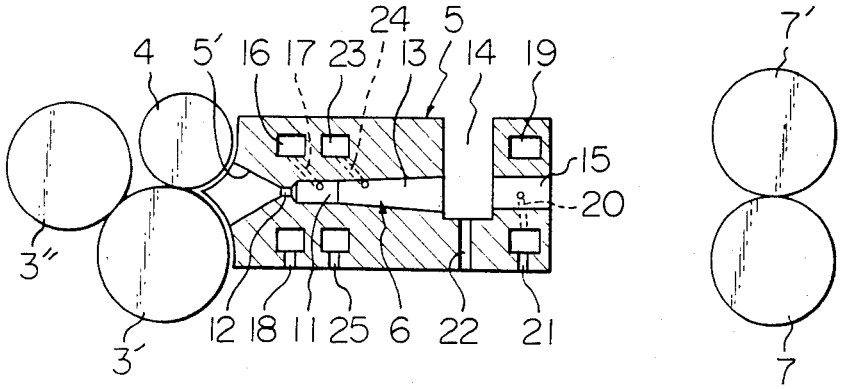
FIG. 2 is a sectional view of an air nozzle according to the present invention.

The structure of the air tube 5 is illustrated in FIG. 2. A rear end of the tube 5 which confronts the front surfaces of the deflection roller 4 and the front bottom roller 3' is of a concave shape so as to complement the surfaces of the rollers 3' and 4 and has a conical inlet recess 5'. Through a core portion of the body of the air tube 5 is provided the fiber passage 6 having a circular cross section. The fiber passage 6 comprises a main path 11 having a constant diameter and a subsidiary path 13 following thereto. An end of the main path 11 is connected to the inlet recess 5' through an orifice 12. A cross section of the subsidiary path 13 increases gradually in the traveling direction of the fiber ribbon, and the furthest end thereof is opened into the midway of a lateral canal 14 which is provided by transversely slotting through the body of the air tube 5 at a depth reaching a level of the fiber passage 6. Accordingly, the fiber passage 6 is of a stepped shape in which the orifice 12, the main path 11, and the subsidiary path 13 are coaxially arranged in series. Through a front portion of the tube 5, an additional path 15 is provided coaxially with the fiber passage 6.

After being delivered from a nip point between the pair of front rollers 3' and 3'', the fiber ribbon is guided to the inlet recess 5' while making contact with a surface of the deflection roller 4, thereby maintaining fiber orientation, and then is introduced into the fiber passage 6. Finally, the yarn is drawn off by the pair of draw-off rollers 7 and 7'.

Figure 3A:
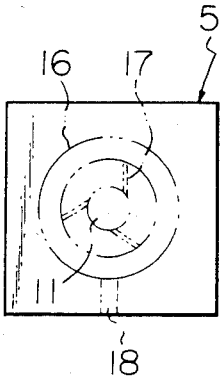
FIGS. 3*a* to 3*c* are perspective views of the air tube shown in FIG. 2, respectively, illustrating jets for generating vortices.
Figure 3B:
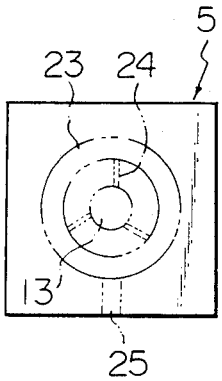

The air tube 5 has an annular chamber 16 around the fiber passage 6, from which a plurality of equidistantly disposed jets 17 extend through the body of the tube 5 to an inner wall of the fiber passage 6. The jets 17 incline in the yarn traveling direction in such a manner that images of the jets 17 are projected onto a plane including the axis of the fiber passage 6 at approximately a 45° angle and deviate from the fiber passage 6 by a predetermined range so that extensions of the jets 17 are circumscribed around an imaginable cylinder having a radius corresponding to the above-mentioned deviation (see FIG. 3*a*). Since the chamber 16 communicates with a high-pressure air source (not shown) through an air supply inlet 18 disposed on the outer surface of the tube 5, air fed from the source is ejected from the jets 17. In the fiber passage 6, the ejected airstream forms vortices having a velocity vector axially in the traveling direction of the fiber bundle, as well as circumferentially around the axis of the fiber bundle (the vortices are referred to as first vortices hereinafter). The first vortices convey the fiber bundle from the front rollers 3' and 3'' through the fiber passage 6 while twisting it around the axis. This twisting is so-called false twisting, by which a twist is first imparted to the fiber bundle during its passage through the upstream region of the first vortices and thereafter the fiber bundle is untwisted at the same rate during its passage through the downstream region thereof. As a result, the residual twist of the fiber bundle should be substantially zero. However, since the fiber bundle utilized in the present invention consists of a plurality of discontinuous staple fibers, less of a twist is imparted to the fibers disposed on the outer portion of the bundle than to those disposed in the inner portion of the bundle due to a brake effect arising between the outer fibers and the inner wall of the fiber passage 6 or the deflection roller 4, and, thus, the less twisted outer portion is entangled around the core portion during its passage through the untwisting area. This is the basic principle of fasciated yarn spinning.

Figure 3C:
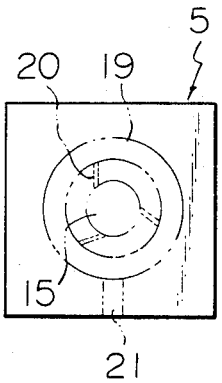

According to the present invention, as is apparent in FIGS. 2 and 3C, an annular chamber 19 is provided around the third path 15, and therefrom a plurality of jets 20 for yarn piecing are arranged equidistantly on the inner wall of the additional path 15. The jets 20 incline in the reverse direction of yarn travel in such a manner that images of the jets 20 are projected onto a plane including the axis of the additional path 15 at an angle of from 0° to 10° relative to a plane perpendicular to the axis by a predetermined amount, as the jets 17. Accordingly, if high-pressure air is supplied from an air supply inlet 21 to the annular chamber 19, vortices whirling in the reverse direction relative to the afore-said first vortices occur around the axis of the additional path 15 due to airstreams ejected from the jets 20 (the vortices are referred to as "second vortices" hereinafter).

Further, at the bottom of the canal 14 is provided a suction nozzle 22. If the suction nozzle 22 communicates with a sub-atmospheric air source (not shown), a sucking stream directing to the nozzle 22 occurs and helps the second vortices in the additional path 15 to flow in the reverse direction of yarn travel in cooperation with the effect of the above-mentioned inclination of the jets 20.

As shown in FIGS. 2 and **3*b*, the air tube 5 further comprises an annular chamber 23 around the fiber passage 6 from which a plurality of equidistantly disposed jets 24 for propelling the fiber bundle extend through the body to the inner wall of the subsidiary path 13. The jets 24 incline in the yarn traveling direction in such a manner that images of the jets 24 are projected onto a plane including the axis of the yarn passage 6 and deviate from the axis of the fiber passage 6 at a lesser amount than in the case of the jets 17. Accordingly, if high-pressure air is supplied from the compressed air source (not shown) to the annular chamber 23 through an air supply inlet 25, vortices having a velocity vector axially and circumferentially in the same direction as that of the afore-said first vortices occur in the subsidiary path 13**. However, the speed of the former is not so fast as the first vortices (the vortices are referred to as "third vortices" hereinafter).

If yarn breakage is detected during fasciated yarn spinning, high-pressure air is supplied to the chamber 19 through the air supply inlet 21 and is ejected from the jets 20 to form third vortices within the additional path 15. At the same time, the suction nozzle 22 communicates with the sub-atmospheric source and, thereby the neighboring air is sucked into the nozzle 22. On the one hand, the broken end of the yarn B of the package 9 is brought to the vicinity of the out end of the additional path 15 by means of a suitable conventional mechanism or by hand and is immediately drawn into the additional path 15 while being rotated reversely in the twisting direction due to the whirling of the second vortices. Finally, the yarn B is sucked into the suction nozzle 22 through the additional path 15. On the other hand, the broken end of the fiber bundle A nipped with the pair of front rollers 3, 3' is also sucked into the suction nozzle 22 while being twisted by the first vortices generated in the main path 11. Therefore, the broken ends of the yarn B and the fiber bundle A are rotated reversely each other within the suction nozzle 22 so that the fibers of both ends are entangled and integrally united.

After confirming the completion of yarn piecing, air supplied to the jets 20 is shut off, and thereby the spinning operation starts again due to the action of the first vortices applied to the fiber bundle.

In the above-mentioned yarn piecing, air supplied to the jets 17 may be shifted to the jets 24 immediately after suction by the suction nozzle 22 and the second vortices occur. This causes the generation of the third vortices and results in a better yarn piecing due to the gentle action of the third vortices compared to that of first vortices.

Figure 4:
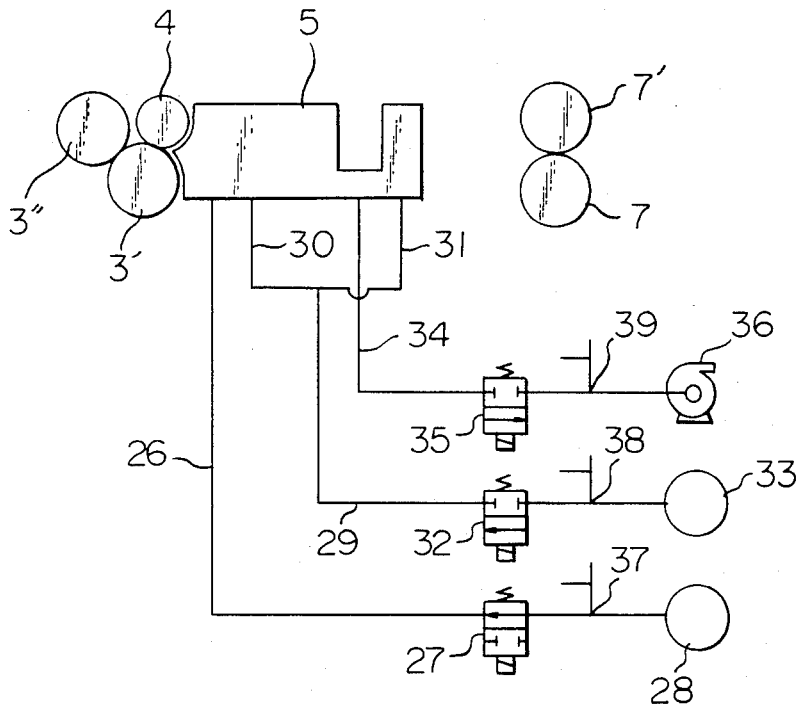
FIG. 4 is a piping plan for carrying out the method according to the present invention.
Figure 5:
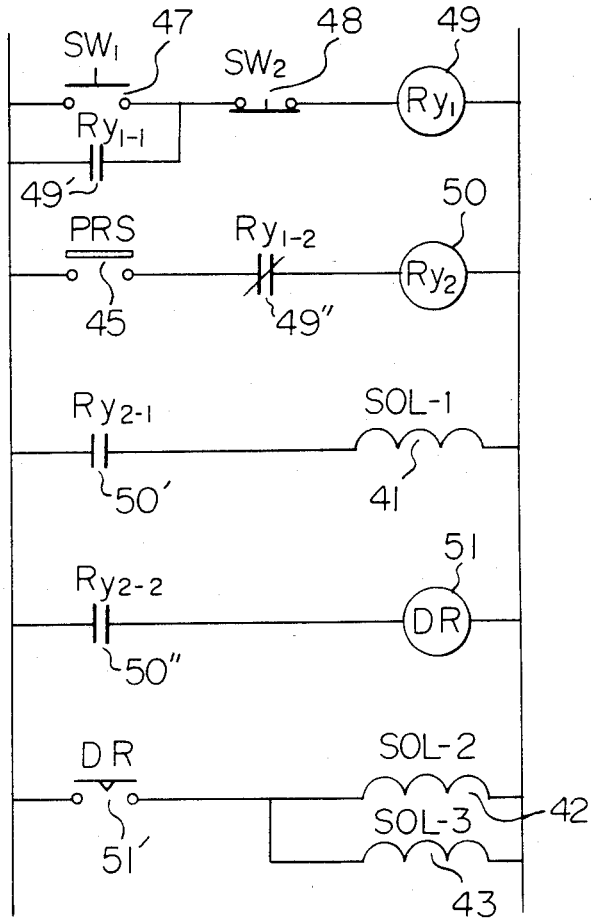
FIG. 5 is a control circuit plan for operating the piping shown in FIG. 4.

FIGS. 4 and 5, respectively, show one embodiment of piping plans and a control circuit thereof, for generating the vortices and the sucking stream within the air tube.

In the drawings, the air supply inlet 18 for the jets 17 communicates with an output of a compressor 28 through a conduit 26 and an electromagnetic valve 27, and the air supply inlets 25 and 21 for the jets 24 and 20, respectively, are connected to branches 30 and 31 of a conduit 29, respectively. The conduit 29 communicates with an output of a compressor 33. To the suction nozzle 22 is connected an input of a blower 36 through an electromagnetic valve 35. FIG. 4 features a piping plan for one unit of the spinning frame, the parts for other units, except for branch portions 37, 38, and 39 of the conduits directed to the other units, being omitted. The electromagnetic valve 27 is opened normally and is closed when a solenoid 41 is excited, and, on the other hand, the electromagnetic valves 32 and 35 are closed normally and are opened when solenoids 42 and 43 are excited, respectively.

When a yarn detecting lever 44 provided on the spinning unit in a conventional manner detects yarn breakage, a switch 45 is closed in accordance with a motion of the lever 44. At the top end of the cradle arm 10 is mounted a switch 47 for generating a yarn piecing starting signal, and on the frame 1 is mounted another switch 48 for generating a yarn piecing completion signal. Both switches 47 and 48 are pushed by the operator at suitable timings.

The switches 47 and 48, as shown in FIG. 5, are connected in series with a power source through an electromagnetic relay 49 designated as $Ry_1$. The switch 47 is also connected parallelly with an "a" contact 49' of the first relay $Ry_1$ for self-maintenance. The switch 45 for yarn breakage detection is connected in series with the power source through a "b" contact 49'' of the first relay $Ry_1$ and a second relay 50 designated as $Ry_2$. The solenoid 41 of the electromagnetic valve 27 is connected in series with the power source through an "a" contact 50' of the second relay 50, and another "a" contact 50'' of the second relay 50 is connected in series with the power source through a time-delay release relay 51 designated as DR. Solenoids 42 and 43 of the electromagnetic valves 32 and 35 are connected parallelly to each other and are also connected in series with the power source through a contact 51' of the time-delay release relay 51. In this connection, the time-delay release relay 51 has the function of closing its contact 51' immediately after being excited and remaining in a closed state for a suitable delay time of less than one second after the power supply is shut off.

Figure 6A:
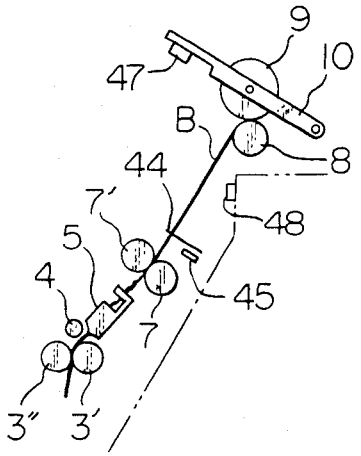
FIGS. 6*a* to 6*e* illustrate the respective steps of yarn piecing according to the present invention.

While the spinning operation continues normally, both of the switches 45 and 47 are in an open state. Accordingly, the coils of the relays 49 and 50 are not excited and, therefore, the solenoids 41, 42, and 43 are also not excited. As a result, the electromagnetic valve 27 is in an open state and the valves 32 and 35 are in a closed state and thereby high-pressure air from the compressor 28 is supplied to the chamber 16 through the air supply inlet 18 and is ejected from the jets 17 to form the first vortices within the fiber passage 6 so that the fiber bundle A is twisted to form the yarn B. During the above-mentioned time period, the second vortices and the third vortices and the sucking stream are not generated. Such a state is illustrated in FIG. 6*a*.

When yarn breakage occurs, the yarn detecting lever 44 operates to close the switch 45. Then the second relay 50 is excited and the "a" contacts 50' and 50'' are closed, thereby exciting the solenoid 41 of the electromagnetic valve 27 and the time-delay release relay 51. Exciting of the time-delay release relay 51 immediately closes the contact 51', thereby exciting the solenoids 42 and 43 of the valves 32 and 35. Thus, since the electromagnetic valve 27 is in a closed state and, on the other hand, the electromagnetic valves 32 and 35 are in an open state, air supplied to conduit 26 is shut off and, instead, high-pressure air from the compressor 33 is fed to the conduit 29. The air supplied to the conduit 29 is branched to conduits 30 and 31 and is ejected from the jets 20 and 24 through the air supply inlet 21 and the chamber 19 and the air supply inlet 25 and the chamber 23, respectively. Moreover, the suction nozzle 22 communicates with the blower 36 through a conduit 34. As a result, the first vortices cease and the second vortices and the third vortices, as well as the sucking stream, are generated in the air tube 5.

Figure 6B:
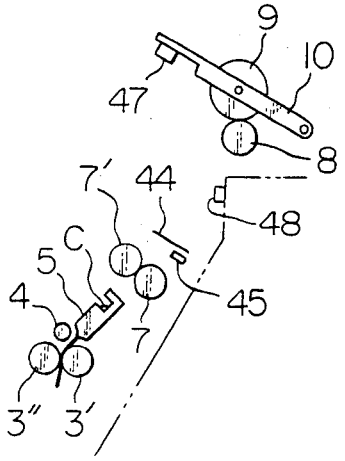

Accordingly, the fiber bundle introduced into the fiber passage 6 is affected by the action of the third vortices. However, since the third vortices are weaker, in respect to whirling action, than the first vortices due to a lesser amount of deflection of the jets 24 from the axis of the fiber passage 6, the former mainly serve to drag the fiber bundle forward. Therefore, the fiber bundle introduced into the fiber passage 6 is not formed in the shape of the yarn B but is sucked out through the suction nozzle 22 which maintaining the form of non-twisted roving having a circular cross section. This state is illustrated in FIG. 6*b*.

Figure 6C:
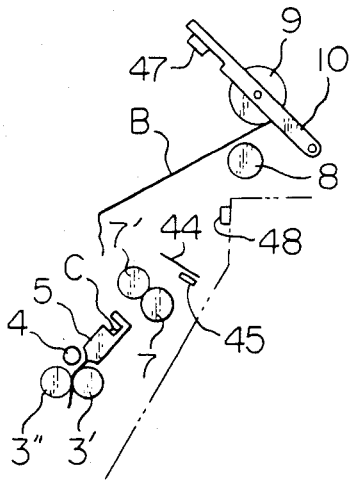
Figure 6D:
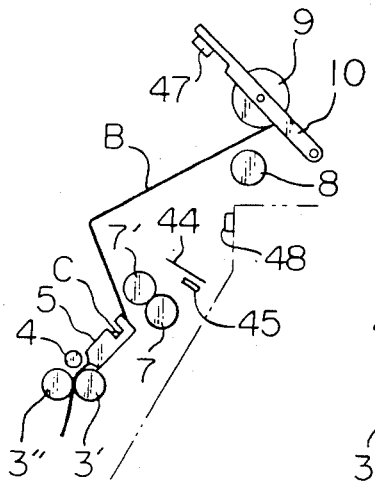

In the yarn piecing operation, the broken end of the yarn B is drawn back from the package 9, as shown in FIG. 6*c*, and is brought directly in front of the out end of the additional path 15. The broken end is affected by the second vortices ejected from the jets 20, thereby the end being rotated reversely by the third vortices while being sucked into the suction nozzle 22. The broken ends of the fiber bundle and the yarn are entangled and united during the above-said rotation.

Figure 6E:
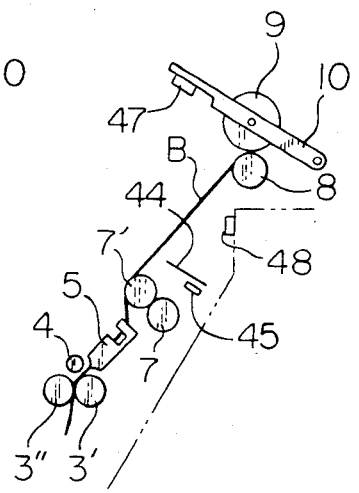

After the completion of piecing, the package 9 starts normal winding of the yarn by contact with the take-up roller 8. At the same time, by pushing the switch 47, the electromagnetic relay 49 is excited and self-maintained due to the closed state of the "a" contact 49', and the relay 50 is de-excited due to the open state of the "b" contact 49'' of the relay 49. Thereby, "a" contact 50' assumes an open state and the solenoid 41 is de-excited to open the valve 27. In this state, the first vortices are generated again within the fiber passage 6 by the jets 17. Since the contacts 50'' and 50' assume an open state, the time-delay release relay 51 opens its contact 51' after a predetermined time period and stops the third vortices, as well as the sucking stream. The yarn B is wound on the package 9 and contacts the upper surface of the draw-off roller 7'. This state is illustrated in FIG. 6*e*.

As the yarn B is continuously wound on the package 9, the yarn tension is restored to the normal level and thereby the yarn is reciprocally traversed over the upper surface of the draw-off roller 7' by grooves provided on the circumference of the take-up roller 8 and is finally drawn in between the pair of rollers 7 and 7' by a notch (not shown) conventionally provided on the circumference of the edge portion of the roller 7'. The yarn B also exerts tension on the lever 44 and restores it to its original position. Thereby, the switch 45 assumes an open state. Thereafter, by pushing the switch 48, the first relay 49 shuts off the power supply and, thus, the "a" contact 49' assumes an open state and the system reverts back to its original position, as shown in FIG. 5.

If the thickness of the fiber bundle is suitable, the above-mentioned yarn piecing operation may be accomplished by continuously ejecting the first vortices and omitting the third vortice.

According to the present invention, when yarn breakage occurs, the fiber bundle delivered from the front rollers is sucked into the suction nozzle, in which the end portion of the fiber bundle is successively torn off by the sucking stream. As a result, the broken end of the fiber bundle always exists within the suction nozzle. At the same time, the broken end of the yarn package is inserted through the additional path into the suction nozzle and is plied with the broken end of the fiber bundle. Under such circumstances, the broken ends are automatically pieced by the first vortices if the yarn begins to be wound again. Further, in the case of piecing, the second vortices formed within the additional path may be useful because the broken end of the package yarn can be more easily sucked into the additional path and twisted in reverse of the fiber bundle which facilitates entanglement of both broken ends.

Additionally, since the canal is provided between the subsidiary path and the additional path, the first and the second vortices never interfere with each other and act upon the respective broken ends independently, thereby assuring rigid entanglement.

According to the invention, since the excess fibers not entangled on the yarn are sucked off into the suction nozzle, the amended portion of the yarn is even in thickness and in strength.

The present invention initially makes it possible manually to piece a broken yarn in fasciated yarn spinning and also makes possible for automatic yarn piecing.

We claim:

1. A yarn piecing apparatus for fasciated yarn spinning which comprises: means for delivering a fiber bundle from a drafting means to an air tube having a fiber passage through said air tube, said fiber passage having a fiber passage exit, said air tube having first vortex forming means for false twisting said fiber bundle, said first vortex forming means being a plurality of first jets provided on an inner circumference of said fiber passage and connected to a high-pressure air source, the plurality of first jets being arranged to provide a first vortex having a velocity vector axially in the travelling direction and circumferentially in the peripheral direction of said fiber bundle, said yarn piecing apparatus comprising a suction nozzle midway of said fiber passage in said air tube and between said first jets and said fiber passage exit in the fiber bundle travelling direction, said suction nozzle being connected to a sub-atmospheric pressure air zone.

2. A yarn piecing apparatus according to claim 1, wherein said air tube further comprises a plurality of second jets provided on an inner circumference of an extension of said fiber passage in such a manner that said suction nozzle is interposed between said first and second jets, said second jets being connected to a high-pressure air source to eject airstreams forming a second vortex within said fiber passage and second vortex having a velocity vector axially and circumferentially in a direction reverse to that of said first vortex.

3. A yarn piecing apparatus according to claim 2, wherein said air tube further comprises a plurality of third jets disposed on an inner circumference of said fiber passage between said first jets and said suction nozzle, said third jets being connected to a high-pressure air source to eject airstreams forming a third vortex within said fiber passage, said third vortex having a velocity vector axially and circumferentially in the same direction as that of said first vortex in relation to said both directions.

4. A yarn piecing apparatus of claim 2 or 3, further comprising a detecting means for yarn breakage provided downstream of said air tube; electromagnetic valves interposed between said jets and said high-pressure air sources and between said suction nozzle and said sub-atmospheric air pressure zone; and a control circuit for opening and closing said valves in response to said yarn breakage detecting means.

5. A yarn piecing apparatus of claim 1, 2 or 3 wherein said air tube has an open canal transversely crossing said fiber passage and said suction nozzle is opened in said canal.

6. A yarn piecing method for joining a first end with a second end of a broken yarn in a fasciated yarn spinning process in which a fiber bundle is delivered from a drafting means and is false-twisted by a first vortex within a fiber passage within an air tube wherein the first end is the end of the bundle delivered from said drafting means, said first vortex having a velocity vector axially in the travelling direction and circumferentially in the peripheral direction of said fiber bundle, to form a fasciated yarn and said second end is the end of the yarn leaving the fiber passage, said yarn piecing method comprising: forming a sucking air stream within the fiber passage within the air tube, downstream of said first vortex in the travelling direction of the fiber bundle; and introducing the first and second ends of the broken yarn into said sucking airstream, whereby said both ends of the broken yarn are entangled and pieced to each other.

7. A yarn piecing method for joining a first end with a second end of a broken yarn in a fasciated yarn spinning process in which a fiber bundle is delivered from a drafting means and is false-twisted by a first vortex within a fiber passage wherein the first end is the end of the bundle delivered from said drafting means, said first vortex having a velocity vector axially in the travelling direction and circumferentially in the peripheral direction of said fiber bundle, to form a fasciated yarn and said second end is the end of the yarn leaving the fiber passage, said yarn piecing method comprising: forming a sucking air stream within the fiber passage, downstream of said first vortex in the travelling direction of the fiber bundle; introducing the first and second ends of the broken yarn into said sucking airstream, whereby said both ends of the broken yarn are entangled and pieced to each other; forming a second vortex in said fiber passage, said second vortex having a velocity vector axially and circumferentially in a direction reverse to that of said first vortex around said second end.

8. A yarn piecing method according to claim 7, further comprising: forming a third vortex having a velocity vector axially and circumferentially in the same direction as the velocity vector of said first vortex around said first end and stopping said first vortex.

9. A yarn piecing method according to claim 6, 7 or 8, wherein said sucking airstream is maintained during the spinning operation irrespective of yarn breakage.

* * * * *